PTH10 XR 4,278,851

United States Patent [19]

Takaya

[11] 4,278,851

[45] Jul. 14, 1981

[54] PIEZOELECTRIC BUZZER

[75] Inventor: Tadashi Takaya, Kyoto, Japan

[73] Assignee: Murata Manufacturing Co., Ltd., Japan

[21] Appl. No.: 71,238

[22] Filed: Aug. 30, 1979

[30] Foreign Application Priority Data

Sep. 7, 1978 [JP] Japan ..... 53-123323[U]

[51] Int. Cl.[3] ..... H04R 1/28; G08B 3/00

[52] U.S. Cl. ..... 179/179; 179/110 A; 179/146 R; 340/384 E

[58] Field of Search ..... 340/384 E, 384 R, 391; 179/110 R, 110 A, 110 C, 110 D, 110 E, 110 F, 179, 146 R; 310/326, 348; 181/171, 172

[56] References Cited

U.S. PATENT DOCUMENTS

| | | | |
|---|---|---|---|
| 3,732,446 | 5/1973 | Bryant | 179/110 A |
| 3,737,690 | 6/1973 | Antonio | 179/110 A |
| 3,879,726 | 4/1975 | Sweany | 179/110 A |
| 4,028,504 | 6/1977 | Massa | 179/179 |

*Primary Examiner*—Thomas A. Robinson

[57] ABSTRACT

A piezoelectric buzzer comprises: a piezoelectric transducer; a casing comprising a hollow body having one end closed by a perforated end wall, a lid adapted to close the other end of the hollow body, and an annular groove defined on the inner peripheral surface of the open end of the hollow body for loosely receiving the peripheral portion of the lid. The annular groove and the lid are so dimensioned and so shaped as to avoid any undesired suppression of the frequency of resonance of the casing which takes place during vibration of the transducer.

8 Claims, 11 Drawing Figures

PIEZOELECTRIC BUZZER

BACKGROUND OF THE INVENTION

The present invention generally relates to a buzzer and, more particularly, to a piezoelectric buzzer employing a piezoelectric composite as a source of a buzzing sound.

Various types of piezoelectric buzzers are currently commercially available, one of which will now be described with reference to FIGS. 1 to 4 of the accompanying drawings.

The prior art piezoelectric buzzer comprises a casing 10, shown in a bottom plan view and in a side sectional view, respectively, in FIGS. 3 and 4, and a piezoelectric composite generally identified by 12 and housed within the casing 10 as best shown in FIG. 4. As best shown in FIGS. 3 and 4, the casing 10 comprises a cylindrical hollow body 14 having one end formed with a pair of spaced mounting lugs 16, opposed to each other and extending radially outwardly therefrom, and the other end closed by an end wall 18 having an opening 20 defined therein concentrically with said end wall 18. The casing 10 further comprises a spacer ring 22 of an outer diameter equal to the inner diameter of the cylindrical hollow body 14, which spacer ring 22 is positioned inside the hollow body 14 and connected to the outer peripheral portion of the end wall 18. In practice, the casing 10 is of one-piece construction with all of the component parts identified by 14, 16, 18 and 22.

The piezoelectric composite 12 comprises, as best shown in FIGS. 1 and 2 in a top plan view and a side sectional view, respectively, a vibrating disc 24 which has a diameter equal to the inner diameter of the hollow body 14 and which may be made of a thin metallic sheet, a layer 26 of piezoelectric material deposited on one surface of the vibrating disc 24, and an electrode layer 28 made of an electroconductive material such as silver or nickel and deposited on one surface of the piezoelectric layer 26 remote from the vibrating disc 24. This piezoelectric composite 12 is positioned within the hollow body 14 with a peripheral portion of the vibrating disc 24 bonded to the spacer ring 22 in spaced relation to the end wall 18 by the use of a bonding agent and with the piezoelectric layer 26 facing in a direction opposite to the end wall 18 as best shown in FIG. 4.

The prior art piezoelectric buzzer of the construction described above and shown in FIGS. 1 to 4 is so designed that, when an electric signal is applied between the electrode layer 28 and the vibrating disc 24, the layer 26 of piezoelectric material is brought into vibration in the axial direction of the vibrating disc 24. Therefore, the piezoelectric composite 12 comprising the layer 26 and the vibrating disc 24, both attached to each other to form a unitary body, vibrates in a bending mode of vibration thereof.

In the prior art piezoelectric buzzer, when the piezoelectric composite 12 vibrates in the manner described above, the initial node of vibration lies in a circular line, shown by the broken line n in FIG. 1, coaxial with the piezoelectric composite 12 and extending inside the vibrating disc 24 in substantial alignment with the periphery of the piezoelectric layer 26, with the maximum amplitude of vibrations taking place at the center of the composite 12 and also at the peripheral portion 30 of the vibrating disc 24. The vibration of the piezoelectric composite 12 within the casing 10 causes the casing 10 to resonate.

With the prior art piezoelectric buzzer of the type referred to above, since the mounting lugs 16 are integral parts of the casing 10 and are, therefore, rigid with the hollow body 14, the vibration of the piezoelectric composite 12 tends to be suppressed, when the piezoelectric buzzer is connected to a support surface, for example, a wall, with set screws threaded through the mounting lugs 16 into the supporting surface, thereby resulting in reduction of the volume of sound produced and also displacement of the frequency of vibration.

SUMMARY OF THE INVENTION

Accordingly, the present invention has been made with the view of substantially eliminating the above described disadvantages and inconveniences inherent in the prior art piezoelectric buzzer and is intended to provide an improved piezoelectric buzzer which, even when connected to the support surface, does not produce a substantial suppression of the vibration.

Another important object of the present invention is to provide an improved piezoelectric buzzer of the type referred to above, which is, therefore, less susceptible to reduction in sound volume produced thereby even when it is connected to the support surface.

A further object of the present invention is to provide an improved piezoelectric buzzer of the type referred to above, which can be manufactured without substantially incurring the increased manufacturing cost.

In order to accomplish these and other objects of the present invention, the present invention provides a piezoelectric buzzer which comprises a piezoelectric composite, a casing comprised of a cylindrical hollow body having one end closed by a perforated end wall, a lid adapted to close the opening at the other end of the hollow body, and means for loosely connecting the lid to the casing such as to permit the casing to move in all directions relative to the lid under the influence of vibrations occurring in the piezoelectric composite within the hollow body even when the piezoelectric buzzer is mounted on a support surface with the lid rigidly secured thereto.

According to one preferred embodiment of the present invention, the loosely connecting means may be composed of an annular groove defined on the inner surface of the hollow body at a position adjacent the open end thereof and having a diameter at least slightly larger than the diameter of the lid. In this preferred embodiment, the lid is received loosely in the annular groove and, therefore, when the buzzer is mounted on a support surface with the lid rigidly secured thereto, the casing can undergo a motion relative to the lid in all directions.

In another preferred embodiment of the present invention, the loosely connecting means may be composed of an elastic bonding agent applied between the annular end face of the hollow body and the lid, which bonding agent when solidified serves as a cushioning layer.

It is possible to use both the annular groove and the bonding agent according to a further preferred embodiment of the present invention.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
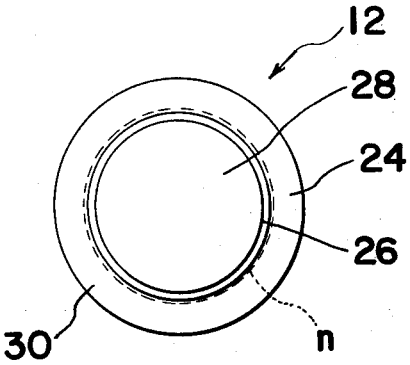
Fig. 1 Prior Art
FIG. 1 is a top plan view of the piezoelectric composite employed in the prior art piezoelectric buzzer.
Figure 3:
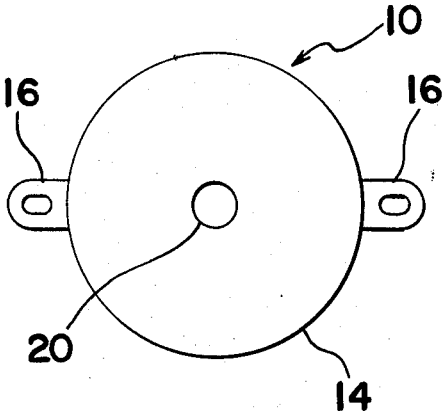
Fig. 3 Prior Art
FIG. 3 is a bottom plan view of the prior art piezoelectric buzzer.

Before the description of the present invention proceeds, it is to be noted that like parts are designated by like reference numerals throughout the accompanying drawings including FIGS. 1 to 4 which illustrate the prior art piezoelectric buzzer forming a subject of improvement according to the present invention.

Figure 5:
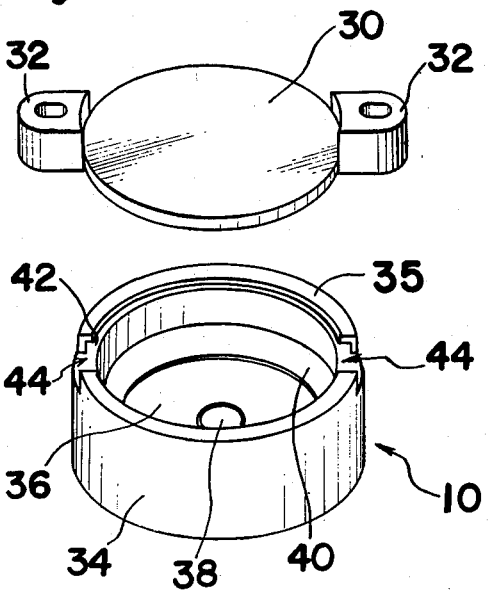
FIG. 5 is a perspective view showing a casing structure, with a lid separated from a casing, according to a first preferred embodiment of the present invention.
Figure 6:
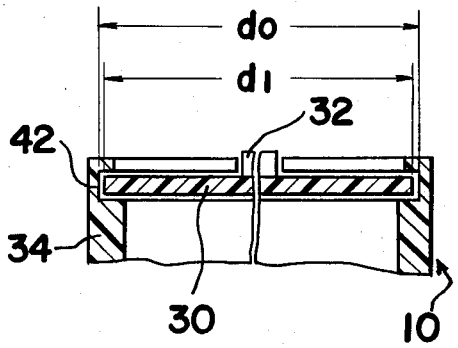
FIG. 6 is a side sectional view of a portion of the casing structure shown in FIG. 5.
Figure 7:
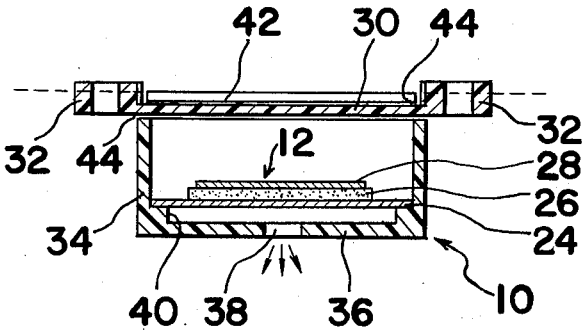
FIG. 7 is a side sectional view of a piezoelectric buzzer employing the casing structure shown in FIGS. 5 and 6.

Referring first to FIGS. 5 to 7, the casing 10 for the accommodation of the piezoelectric composite 12 according to the present invention comprises a disc lid 30 having a pair of spaced perforated mounting lugs 32, opposed to each other and extending radially outwardly therefrom. Each of said perforated mounting lugs 32 has a thickness larger than the thickness of the disc lid 30, as best shown in FIG. 7. A cylindrical hollow body 34 having first and second ends opposed to each other is also provided, the first end of said cylindriical hollow body 34 being open and the second end thereof being closed by an end wall 36 having an opening 38 defined therein. The hollow body 34 also has a spacer ring 40 of an outer diameter equal to the inner diameter of the cylindrical hollow body 34, said spacer ring 40 being positioned inside the hollow body 34 and connected to the outer peripheral portion of the end wall 36. In practice, as is the case with the casing used in the prior art piezoelectric buzzer, the casing used in the present invention is of one-piece construction with all of the component parts identified by 34, 36, 38 and 40.

Figure 2:
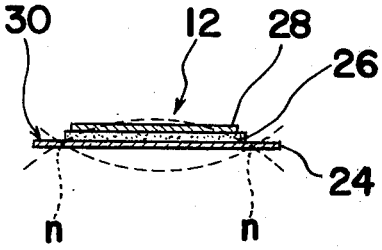
Fig. 2 Prior Art
FIG. 2 is a side sectional view of the piezoelectric composite shown in FIG. 1.
Figure 4:
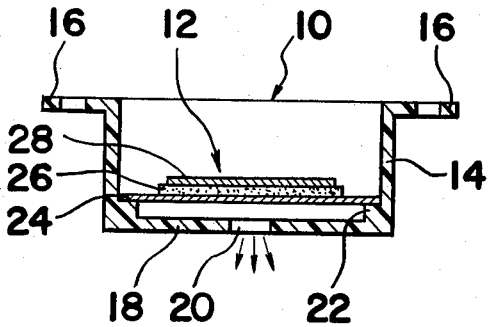
Fig. 4 Prior Art
FIG. 4 is a side sectional view of the prior art piezoelectric buzzer.

The piezoelectric composite 12, the construction of which has already been shown in and described with particular reference to FIGS. 1 and 2, is positioned within the hollow body 34 with a peripheral portion of the vibrating disc 24 bonded to the spacer ring 40 in spaced relation to the end wall 38 by the use of any known bonding agent while the piezoelectric layer 26 faces in a direction opposite to the end wall 38 as best shown in FIG. 7. It is to be noted that the piezoelectric composite 12 constitutes a piezoelectric transducer operable to convert an electric signal into a physical signal, that is, a sound.

In accordance with the present invention, the inner peripheral surface of the hollow body 34 is formed with an annular groove 42 positioned adjacent the open end of said hollow body 34 and spaced from the annular end face 35 of the open end of said hollow body 34 a predetermined distance smaller than the thickness of each of the mounting lugs 34 in the disc lid 30 for a reason which will become clear from the subsequent description. The annular groove 42 so defined has a groove width slightly larger than the thickness of the disc lid 30 and a diameter do slightly larger than the diameter dl of the disc lid 30. It is to be noted that the diameter dl of the disc lid 30 is larger than the inner diameter of the hollow body 34, but smaller than the outer diameter of the hollow body 34.

As best shown in FIG. 5, the open end of the hollow body 34 is formed with a pair of opposed cutout portions 44 each extending from the annular end face of the open end of the hollow body 34 and terminating flush with one of the walls defining the annular groove 42 which is parallel to the plane of, and remote from, the annular end face 35 of the open end of the hollow body 34. Each of these cutout portions 44 is so shaped as to make the opening of the hollow body 34 wide-mouthed to receive the corresponding mounting lug 32 therein when the lid 30 is mounted on the hollow body 34 in a manner as will subsequently be described.

As best shown in FIG. 7, the disc lid 30 is mounted on the hollow body 34 with its peripheral portion loosely received in the annular groove 42 and the mounting lugs 32 received in the corresponding cutout portions 44. In designing the mounting lugs 32 and selecting the position of the annular groove on the inner peripheral surface of the hollow body 34, care must be taken that, when the disc lid 30 is so mounted on the hollow body 34 in the manner described above, the mounting lugs 32 always protrude axially from the plane of the annular end face of the open end of the hollow body 34 even though the hollow body 34 is axially displaced in either direction a distance corresponding to the difference between the thickness of the disc lid 30 and the groove width of the annular groove 42. More specifically, the casing 10 according to the present invention is so designed that, when the piezoelectric buzzer embodying the present invention is secured to a support surface with set screws threaded through the perforations in the mounting lugs 32 to the support surface, the casing 10 can move in all directions relative to the disc lid 30. The distance through which the hollow body 34 can move freely in an axial direction corresponds to the difference between the groove width of the annular groove 42 and the thickness of the disc lid 30, while the distance through which the hollow body 34 can move freely laterally corresponds to the difference between the diameter do of the annular groove 42 and the diameter dl of the disc lid 30.

In view of the loose connection between the disc lid 30 and the hollow body 34 in the manner described above, not only can the possibility of reduction in sound pressure be eliminated, but also any undesirable variation in frequency characteristic can also be avoided substantially.

Figure 8:
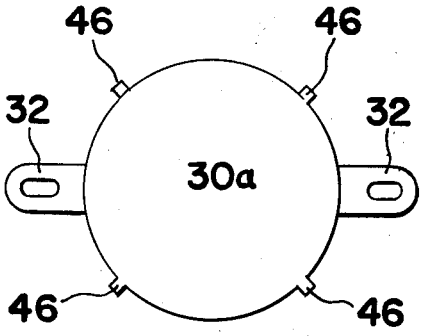
FIG. 8 is a top plan view of a lid forming a part of the casing structure according to another preferred embodiment of the present invention.

In the foregoing embodiment shown in FIGS. 5 to 7, the disc lid 30 has been described as having a diameter dl slightly smaller than the diameter do of the annular groove 42. However, as shown in FIG. 8, the disc lid 30*a* may have a diameter equal to or slightly smaller than the inner diameter of the hollow body 34, in which case the disc lid 30*a* should have a plurality of equally spaced tongues 46 extending radially outwardly therefrom and adapted to be received in the annular groove 42 when the disc lid 30*a* is mounted on the hollow body 34 in a manner similar to that described in connection with the foregoing embodiment. This construction of the disc lid 30*a* is advantageous in that the surface area of contact of the disc lid 30*a* to the cylindrical hollow body 34 can be minimized and, therefore, the damping of the sound produced by the piezoelectric buzzer embodying the present invention can be minimized.

Figure 9:
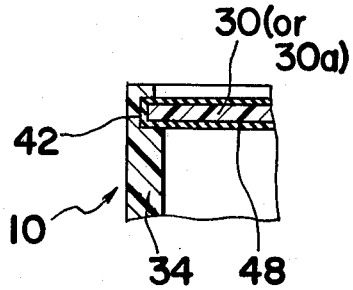
FIG. 9 is a side sectional view of a portion of the casing structure employing the lid shown in FIG. 8.

Irrespective of whether the disc lid 30 of the construction shown in FIGS. 5 to 7 is employed or whether the disc lid 30*a* of the construction shown in FIG. 8 is employed, at least the peripheral portion of the disc lid 30 or 30*a*, which is received in the annular groove 42 when it is mounted on the hollow body 34, may be covered with a layer 48 of an elastic bonding agent, for example, a silicone bonding agent, which, when solidified, provides an elastic layer, such as shown in FIG. 9. The use of the elastic layer 48 may bring about a slight suppression of the sound produced, but is advantageous in that the loose movement of the hollow body 34 relative to the disc lid 30 or 30*a*, such as occurs with the casing 10 using the disc lid 30 or 30*a*, can be compensated for by the elasticity of the layer 48.

Figure 10:
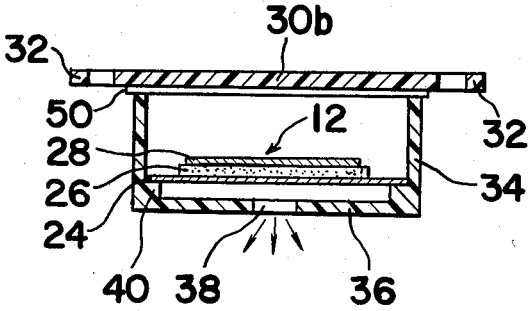
FIG. 10 is a side sectional view of a piezoelectric buzzer according to a further preferred embodiment of the present invention.

In the embodiment shown in FIG. 10, while the disc lid 30*b* has a diameter equal to or larger than the outer diameter of the hollow body 34, the hollow body 34 with the piezoelectric composite 12 therein is coupled to the disc lid 30*b* with the annular end face of the open end thereof bonded to said disc lid 30*b* by the use of an elastic bonding agent, for example, a silicone bonding agent, which provides an elastic layer 50 between the disc lid 30*b* and the annular end face of the hollow body 34. This arrangement shown in FIG. 10 is advantageous in that, not only can the loose movement of the hollow body 34 relative to the disc lid 30*b* be compensated for by the elasticity of the layer 50, but also the hollow body 34 can readily and easily be manufactured without requiring a relatively complicated procedure such as required to form the annular groove 42.

Figure 11:
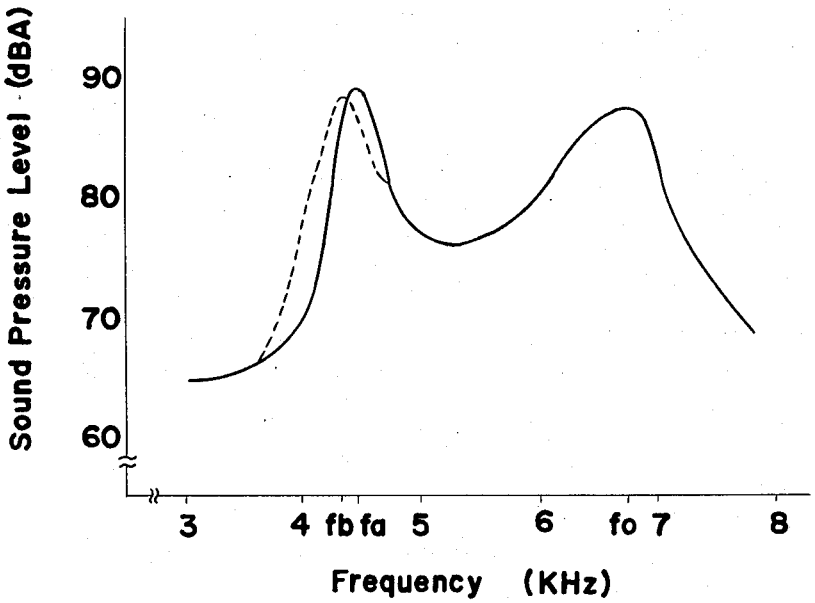
FIG. 11 is a graph showing variation in sound pressure produced by the piezoelectric buzzer of the present invention relative to variation in frequency.

Shown in FIG. 11 is a graph showing the sound pressure versus frequency characteristic of the piezoelectric buzzer of the construction substantially shown in and described with referece to FIGS. 5 to 7, but wherein a silicone rubber layer is formed by applying a silicone bonding agent to each portion of the periphery of the disc lid 30 adjacent one of mounting lugs 32. It will readily be seen that, by the use of such silicone layers, the resonant frequency fa can be reduced to a resonant frequency fb as shown by the broken line. In other words, by the use of the silicone layer or layers, the resonant frequency of the piezoelectric buzzer embodying the present invention can be adjusted to any desired resonant frequency.

The adjustment of the resonant frequency of the piezoelectric buzzer embodying the present invention can also be achieved by suitably selecting the shape of the piezoelectric composite 12 in such a manner as to reduce or increase the frequency fo produced by said piezoelectric composite 12 and, then, to render the resonant frequency to be correspondingly reduced or increased. However, it is often desired to manufacture piezoelectric buzzers capable of producing sounds of different frequency by the utilization of piezoelectric composites, i.e., transducers, of identical construction and identical performance. In such a case, the use of an elastic bonding agent to form the elastic layer or layers is a very convenient and economical means for achieving the adjustment of the resonant frequency of the piezoelectric buzzer embodying the present invention.

Although the present invention has fully been described in connection with the preferred embodiments thereof with reference to the accompanying drawings, it is to be noted that various changes and modifications are apparent to those skilled in the art. By way of example, although each of the mounting lugs 32 has been described as protruding outwards from the disc lid, it may not be always necessary and, instead thereof, the disc lid may have two or more spacer projections which serve as nuts for receiving respective set screws inserted through the support surface and threaded into such spacer projections.

Accordingly, such changes and modifications are to be understood as included within the true scope of the present invention unless they depart therefrom.

What is claimed is:

1. A piezoelectric buzzer, comprising:

transducer means for producing a sound when energized;

casing means accommodating said transducer means, said casing means comprising a hollow body having one end closed by a perforated end wall and having an open end;

lid member means for closing said open end, said lid member means having a pair of spaced mounting lugs protruding outwards therefrom and opposed to each other; and means for loosely connecting said lid member to said casing means to permit said casing means to move freely in all directions with respect to said lid member means.

2. A piezoelectric buzzer, comprising:

transducer means for producing a sound when energized;

casing means accommodating said transducer means, said casing means comprising a hollow body having one end closed by a perforated end wall and having one end open;

lid member means for closing said open end, and means for loosely connecting said lid member means to said casing means to permit said casing means to more freely in all directions with respect to said lid member means, said connecting means comprising an annular groove defined on the inner peripheral surface of said hollow body and surrounding said open end thereof, said annular groove being adapted to loosely receive said lid member means.

3. The buzzer of claim 2, wherein said lid member means has a pair of spaced mounting lugs protruding outwards therefrom and opposed to each other.

4. The buzzer of claim 2, wherein said lid member means has a thickness slightly smaller than the width of said annular groove, but larger than the inner diameter of said hollow body.

5. The buzzer of claim 4, wherein said lid member means further comprises a plurality of tongues integrally formed therewith and extending radially outwardly therefrom, said tongues being loosely received in said annular groove when said lid member means is in position closing said open end of said hollow body.

6. The buzzer of claim 4, 1, 2 or 5, further comprising elastic means secured to said lid member means for adjusting the frequency of resonance of said buzzer.

7. The buzzer of claim 6, wherein said elastic means comprises at least one elastic layer formed on the peripheral portion of said lid member means.

8. The buzzer of claim 4, or 2, wherein said open end of said hollow body is secured to said lid member means by means of an annular elastic layer of bonding agent which concurrently serves as means for adjusting the frequency of resonance of said casing.

* * * * *

!78851 U 140 082
BOSE / BOX 711
!CESSIUN #PF-119
ANETTE GATLING
STAPLES AT BOITUM
28020S ZIP:
ND IO MAILROOM
'28 TL X301